US005267551A

United States Patent [19]

Sui

[11] Patent Number: 5,267,551

[45] Date of Patent: Dec. 7, 1993

[54] TURNTABLE EQUIPPED WITH GAS PIPELINE

[76] Inventor: Huang L. Sui, No. 23, Yo Ai Road, Chia Yi City, Taiwan

[21] Appl. No.: 986,007

[22] Filed: Dec. 4, 1992

[51] Int. Cl.[5] ..... F24C 3/00

[52] U.S. Cl. ..... 126/39 L; 126/50

[58] Field of Search ..... 126/39 R, 39 L, 41 B, 126/50, 33, 52

[56] References Cited

U.S. PATENT DOCUMENTS 1,158,475 11/1915 Fox ..... 126/39 L 4,243,013 1/1981 Goon ..... 126/43

FOREIGN PATENT DOCUMENTS 566576 11/1958 Canada ..... 126/39 L

*Primary Examiner*—James C. Yeung

*Attorney, Agent, or Firm*—Bacon & Thomas

[57] ABSTRACT

A turntable equipped with a gas pipeline includes a hopper having a passage along its axis adapted to receive one end of a gas pipeline and gas supply pipeline. The other end of the gas pipeline is connected to a gas stove through a turntable. When the turntable is rotating, the gas pipeline will rotate simultaneously therewith. Three O-rings located on the end of the gas pipeline extending into the hopper prevent gas from leaking therefrom.

3 Claims, 5 Drawing Sheets

TURNTABLE EQUIPPED WITH GAS PIPELINE

FIELD OF THE INVENTION

This invention relates to a turntable. More particularly, a turntable equipped with a gas pipeline that is rotatable turnable along with the turntable.

BACKGROUND OF THE INVENTION

Most chinese restaurants have turntables prepared for the convenience of serving food so that dining people do not have to get up to pick up or ask someboby's help to pass the foods which all located away from them. A turntable is definitely the most convenient means for this problem. But in many circumstances, chinese foods are required to be served in warm and a pot on the table is needed to keep foods warm. This pot generally utilizes electric or gas as its power. However such power sources require a cord hooked to either an electric outlet or a gas outlet which are inconvenient to the people seating next to it, such as the turntable shown in FIG. 5. Furthermore, the cord extremely limits the rotation of the turntable.

It is therefore, an object of the inventor to provide a rotatable which includes a gas pipeline that is turnable along with the turntable.

SUMMARY OF THE INVENTION

It is the primary object of the present invention to provide a with turntable equipped with gas pipeline which is rotatable along with the turntable and will not leak gas.

It is another object of the present invention to provide a turntable equipped with a gas pipeline in which the gas cord will not cause any inconvenience to any person seating at the table.

It is still another object of the present invention to provide a turntable equipped with a gas pipeline which is safe in use.

It is a further object of the present invention to provide a turntable equipped with a gas pipeline which is easy to install.

It is still a further object of the present invention to provide a turntable equipped with a gas pipeline which is inexpensive to manufacture.

DETAILED DESCRIPTION OF THE PREFERRED EMBODIMENT

Figure 1:
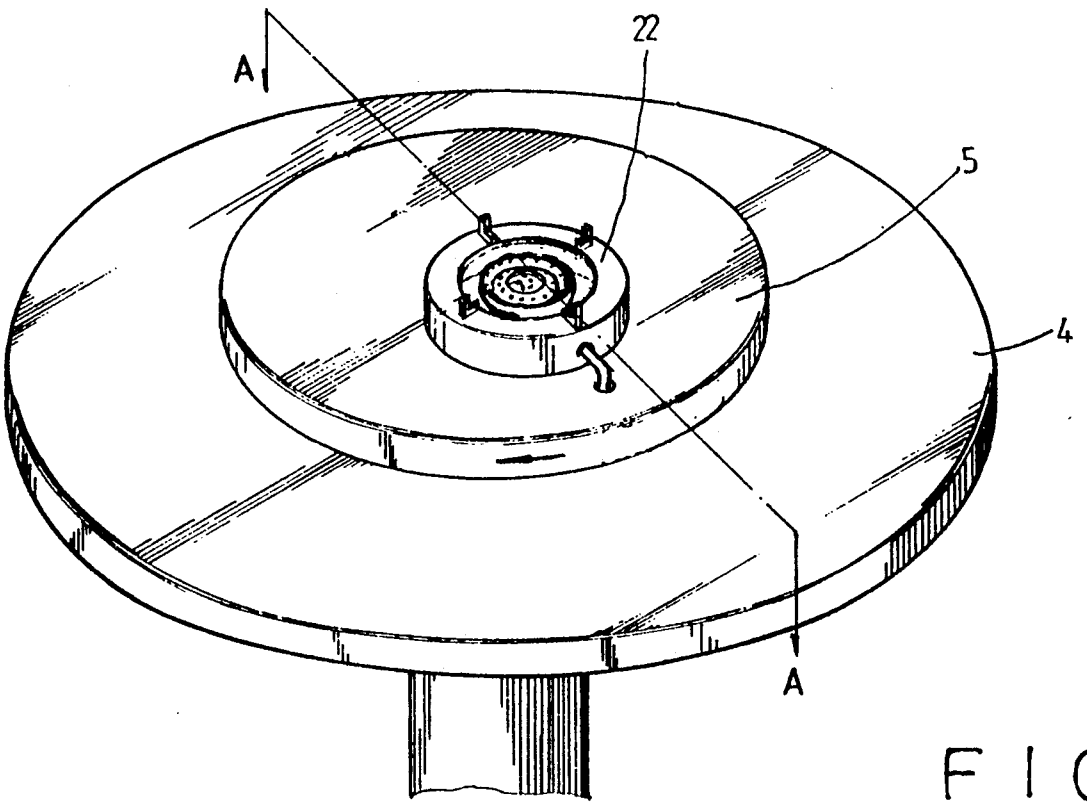
FIG. 1 is a perspective view of the present invention.
Figure 2:
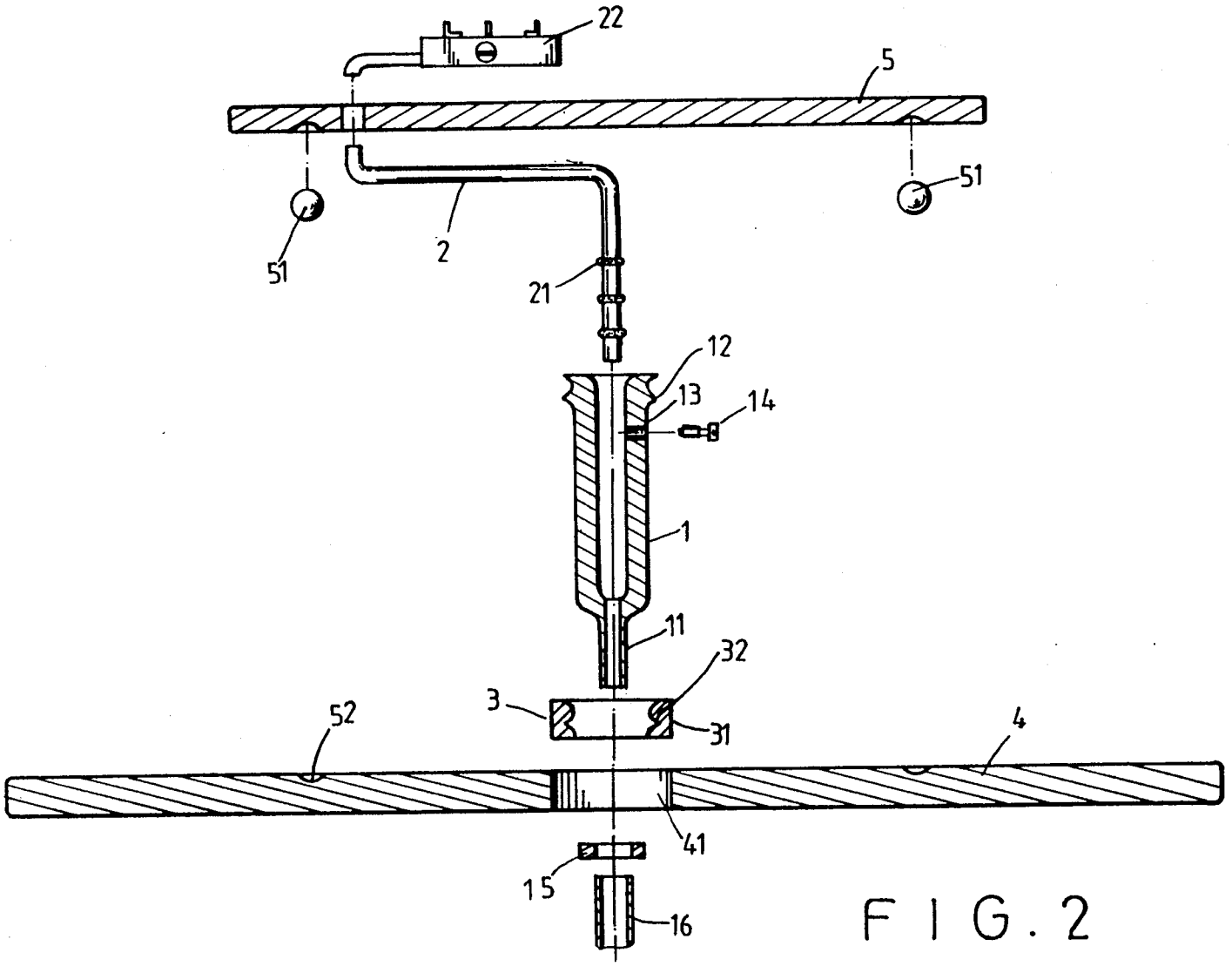
FIG. 2 is a fragmentary view in cross section taken along line A—A of FIG. 1.
Figures 3A, 3B:
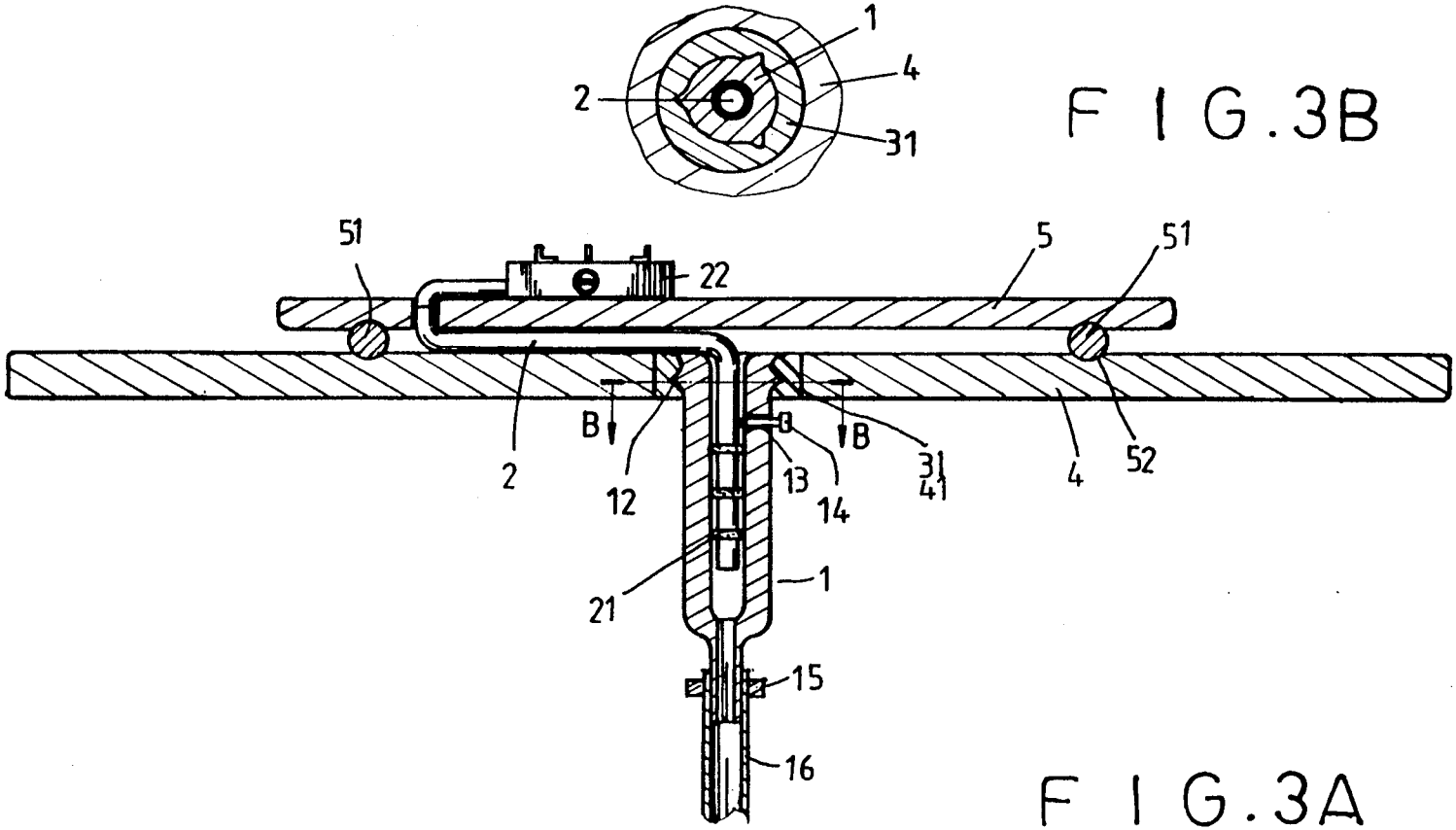
FIG. 3A is a side-elevational view of FIG. 2, in cross section.
FIG. 3B is a top cross-sectional view of the present invention taken along line B—B of FIG. 3A.
Figure 4:
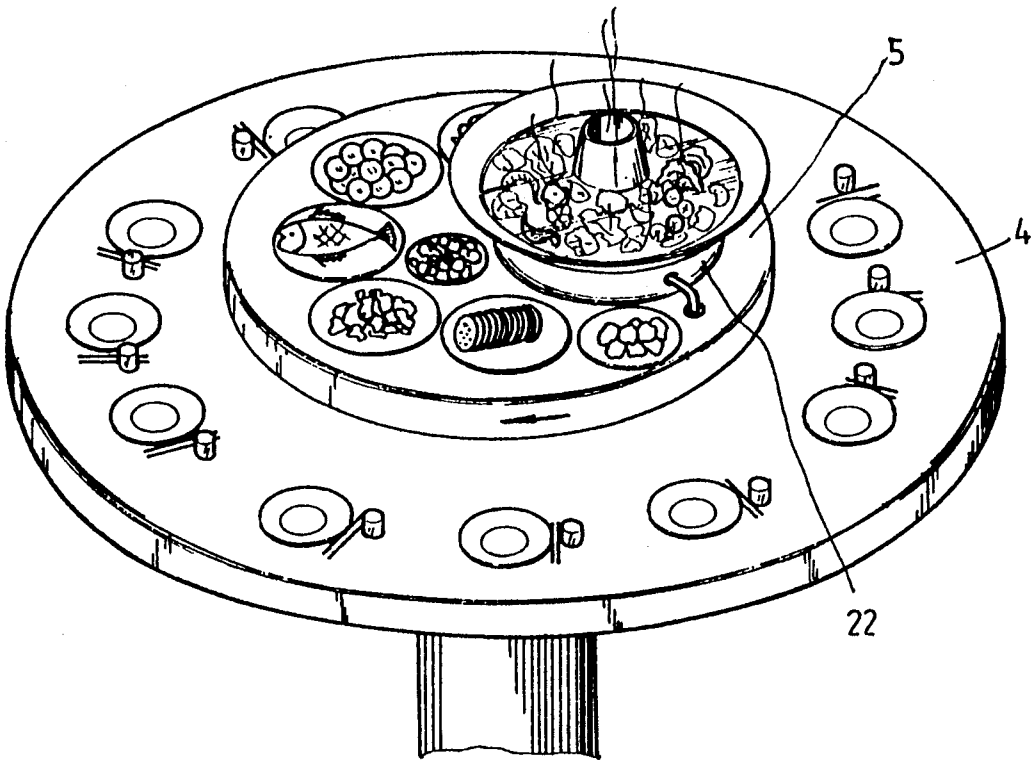
FIG. 4 is a perspective view, showing a pot sitting on the present invention.
Figure 5:
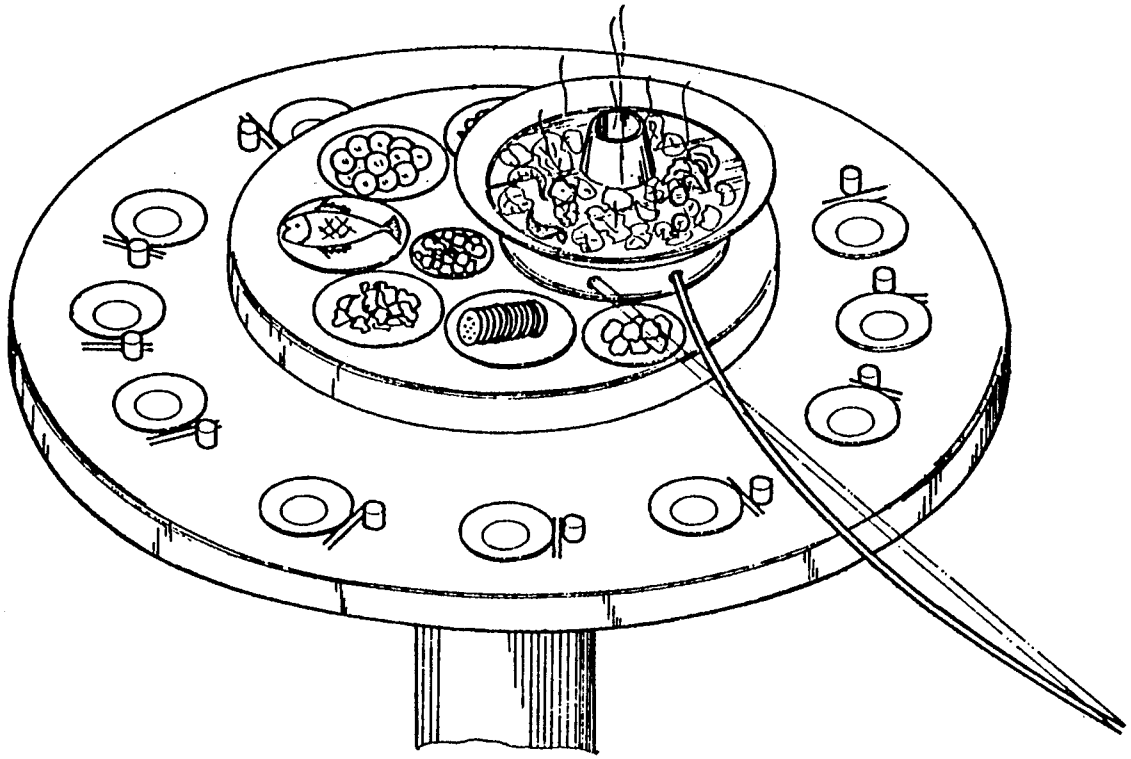
FIG. 5 PRIOR ART
FIG. 5 is a prior art arrangement.

Reference now to the drawings wherein the showings are for the purpose of illustrating a preferred embodiment of the invention only and not for the purpose of limiting the same, FIGS. 1 and 2 show the present invention essentially composed of a hopper 1, a gas pipeline 2, a fixture 3, a dining table 4 having an aperture 41 at the center thereof, and a turntable 5.

The hopper 1, having a passage along its axis, has a reduced diameter portion 11 at the bottom portion thereof adapted to be inserted into a gas supply pipeline 16 and secured by a clamp 15, three protuberances 12 at a top portion, and a female threaded aperture 13 at one side for receiving a threaded fastener 14 for fastening the gas pipeline 2 securely.

One end of the gas pipeline 2 is connected to a stove 22 while the other end has a plurality of O-rings 21 inserted into the hopper 1 and adapted to seal the hole of the hopper 1 and preventing gas leak therefrom.

The fixture 3 to be secured in the aperture 41 of the dining table 4, has a hole at its center portion concentric with respect to the aperture of the table 4 adapted to receive the hopper 1 therein. Three recesses 32 are formed at the inner periphery of the hole for engagement by the three protuberances 12 of the hopper 1.

A recess 52 of semi-circular corss-section surrounding the aperture 41 concentrically at the top portion is defined as a socket on which a series of balls 51 seat therein.

The turntable 5 also has a recess of semi-circular cross-section circumferentially at its bottom portion which is defined as a socket which is in alignment with the socket of the table 4 and in which the balls 51 are engaged.

To assemble, the fixture 3 is first inserted into the aperture 41 of the table 4, is inserted the hopper 1 through the aperture of the fixture 3 with the three protuberanes 13 in engagement with the three recesses 32, respectively, to prevent the hopper 1 from rotating along with the rotation of the turntable 5. The reduced diameter portion 11 of the gas pipeline 2 is inserted into a gas supply pipeline 16 and fastened by a clamp 15. Thus, when rotating the turntable 5, the gas inlet pipeline 2 will rotate simultaneously, but the hopper 1 will remain still. Furthermore, the three O-rings 21 prevent gas from leaking.

I claim:

1. A gas pipeline apparatus for a table having a rotatable turntable thereon, the apparatus comprising:

a) a fixture having a center hole and a plurality of recesses formed in a periphery of the center hole, the fixture being securable within an aperture of a table;

b) a hopper including a top portion having a plurality of protuberances thereon and a reduced diameter bottom portion for connection with a gas supply line, the hopper being insertable through the center hole of the fixture and secured against rotation through engagement of the plurality of protuberances within the plurality of recesses; and c) a gas pipeline having first and second ends, the first end for connection to a gas stove supported on top of a turntable and the second end being engageable with the hopper for receiving gas from the gas supply line, whereby the gas pipeline is rotatable with the turntable relative to the hopper.

2. The gas pipeline apparatus of claim 1 further including:

a) means for securing the second end of the gas pipeline to the hopper; and b) means for sealing the second end of the gas pipeline to the hopper for preventing gas leak therefrom.

3. The gas pipeline apparatus of claim 2 wherein:

a) the means for securing the second end of the gas pipeline to the hopper includes a threaded aperture extending through one side of the hopper and a threaded fastener engaged within the threaded aperture; and b) the means for sealing the second end of the pipeline to the hopper includes a plurality of O-rings.

* * * * *